US005487428A

United States Patent [19]

Yamamoto et al.

[11] Patent Number: 5,487,428

[45] Date of Patent: Jan. 30, 1996

[54] STRAIGHT-AHEAD TRAVELING CONTROL SYSTEM FOR A BULLDOZER

[75] Inventors: Shigeru Yamamoto; Shigenori Matsushita; Shu huai Zhang; Satoru Nishita; Kazushi Nakata, all of Hirakata, Japan

[73] Assignee: Kabushiki Kaisha Komatsu Seisakusho, Tokyo, Japan

[21] Appl. No.: 264,348

[22] Filed: Jun. 23, 1994

[30] Foreign Application Priority Data

Jun. 23, 1993 [JP] Japan ..... 5-152406

[51] Int. Cl.[6] ..... A01B 63/111; E02F 3/76

[52] U.S. Cl. ..... 172/4.5; 172/7; 37/266; 364/424.07

[58] Field of Search ..... 37/234, 266; 172/4.5, 172/7, 812, 814, 821; 364/424.07, 474.02, 474.09, 474.34, 505

[56] References Cited

U.S. PATENT DOCUMENTS

| | | | |
|---|---|---|---|
| 3,572,444 | 3/1971 | Scholl | 172/4.5 |
| 3,899,028 | 8/1975 | Morris et al. | 172/4.5 |
| 3,974,699 | 8/1976 | Morris et al. | 172/4.5 X |
| 4,282,933 | 8/1981 | Suganami et al. | 172/4.5 |
| 4,537,259 | 8/1985 | Funabashi et al. | 172/4.5 |
| 4,630,685 | 12/1986 | Huck, Jr. et al. . | |
| 4,934,463 | 6/1990 | Ishida et al. | 172/4.5 |

FOREIGN PATENT DOCUMENTS

| | | | |
|---|---|---|---|
| 53-6967 | 2/1978 | Japan . | |
| 53-5441 | 2/1978 | Japan . | |
| 55-36776 | 2/1980 | Japan . | |
| 63-31618 | 6/1988 | Japan . | |
| 3-226417 | 9/1988 | Japan | 172/4.5 |
| 3-210315 | 9/1988 | Japan | 172/4.5 |
| 1-62525 | 3/1989 | Japan . | |
| 2-204534 | 8/1990 | Japan | 172/4.5 |
| 3-43523 | 2/1991 | Japan . | |
| 6-3886 | 2/1994 | Japan . | |

*Primary Examiner*—Randolph A. Reese
*Assistant Examiner*—Robert Pezzuto
*Attorney, Agent, or Firm*—Armstrong, Westerman, Hattori, McLeland & Naughton

[57] ABSTRACT

A straight-ahead traveling control system for a bulldozer comprising: (a) a driving mode setting device which can set an automatic blade control mode for dozing operation; (b) a yaw angle detector for detecting the yaw angle of a vehicle body in relation to a target traveling direction for the vehicle body; (c) a blade tilt angle detector for detecting the tilt angle of the blade tilting laterally in relation to the ground; and (d) a blade controller for controlling tilting of the blade based on a first blade tilting amount used for driving the vehicle body straight ahead and a second blade tilting amount used for forming a laterally horizontal earth surface after digging by the blade, the first blade tilting amount being obtained from the yaw angle of the vehicle body detected by the yaw angle detector and the second blade tilting amount being obtained from the tilt angle of the blade detected by the blade tilt angle detector, when the driving mode setting device has set the automatic blade control mode.

13 Claims, 7 Drawing Sheets

STRAIGHT-AHEAD TRAVELING CONTROL SYSTEM FOR A BULLDOZER

BACKGROUND OF THE INVENTION

1. Field of the Invention

The present invention relates to a straight-ahead traveling control system for a bulldozer and, more particularly, to a technique for controlling the bulldozer to move straight on a desired course during dozing operation.

2. Description of the Prior Art

Dozing operation by the use of a bulldozer has been previously performed In such a way that by fully manual operation of the operator who drives a bulldozer, a blade is lifted or lowered so that the load applied to the blade during digging and carrying can be kept substantially constant. In such dozing operation, the operator operates a steering lever or a blade control lever (tilt lever) for fixing the course of the bulldozer.

SUMMARY OF THE INVENTION

To drive the bulldozer on a desired course while performing dozing operation by manually operating the blade to be lifted or lowered disadvantageously brings tremendous fatigue to the operator, even if he is very skillful. Another disadvantage is that the above operation itself is very complicated and difficult to carry out not only for unskilled operators who soon get exhausted but also for experienced operators.

The present invention has been made in order to overcome the above disadvantages and therefore one of the objects of the invention is to provide a straight-ahead traveling control system for a bulldozer in which it is not necessary for the operator to operate levers for driving the bulldozer on a desired course, so that dozing operation can be efficiently performed without causing tremendous fatigue to the operator.

In order to accomplish the above object, a straight-ahead traveling control system for a bulldozer according to the invention comprises:

(a) driving mode setting means which can set an automatic blade control mode for dozing operation;

(b) yaw angle detector means for detecting the yaw angle of a vehicle body in relation to a target traveling direction for the vehicle body;

(c) blade tilt angle detector means for detecting the tilt angle of the blade tilting laterally in relation to the ground; and (d) blade controller means for controlling tilting of the blade based on a first blade tilting amount used for driving the vehicle body straight ahead and a second blade tilting amount used for forming a laterally horizontal earth surface after digging by the blade, the first blade tilting amount being obtained from the yaw angle of the vehicle body detected by the yaw angle detector means and the second blade tilting amount being obtained from the tilt angle of the blade detected by the blade till angle detector means, when the driving mode setting means has set the automatic blade control mode.

According to the arrangement of the above straight-ahead traveling control system, when the automatic blade control mode for dozing operation has been set, the blade controller means obtains the first blade tilting amount used for driving the vehicle body straight ahead from the yaw angle of the vehicle body in relation to a target traveling direction for the vehicle body, the yaw angle being detected by the yaw angle detector means, and obtains the second blade tilting amount used for forming a laterally horizontal earth surface after digging by the blade from the tilt angle of the laterally tilting blade in relation to the ground, the tilt angle being detected by the blade tilt angle detector means. Then, the blade controller means controls tilting of the blade based on the first and second blade tilting amounts thus obtained.

With this arrangement, in cases where a partial load is applied to the blade and the traveling direction of the vehicle body is therefore changed when the automatic blade control mode is selected, the lateral tilt angle of the blade relative to the ground is altered so that the vehicle body resumes its previous traveling direction. In cases where the vehicle body is inclined in its rolling direction, causing the blade to be tilted relative to the ground, the lateral tilt angle of the blade is also altered so that the blade becomes horizontal in relation to the ground.

Preferably, the blade controller means obtains a final blade tilting amount by adding the first blade tilting amount to the second blade tilting amount, and controls tilting of the blade in accordance with the final blade tilting amount.

The blade tilt angle detector means preferably includes rolling angle detector means for detecting the rolling angle of the vehicle body in relation to the ground and blade angle detector means for detecting the tilt angle of the laterally tilting blade in relation to the vehicle body. In this case, the rolling angle detector means may be a detector that detects the rolling angle by integrating data sent from a rolling rate gyro for releasing a rolling angle speed as an output, or may be a rolling angle sensor that directly detects the rolling angle. The blade angle detector means may be a detector that detects the tilt angle of the laterally tilting blade by detecting the difference between the respective pivotal angles of right and left blade lift cylinders for lifting or lowering the blade, or may be a detector that detects the tilt angle of the laterally tilting blade by detecting the difference between the respective cylinder lengths of the right and left blade lift cylinders for lifting or lowering the blade.

The yaw angle detector means may be a detector that detects the yaw angle by integrating data sent from a yaw rate gyro for releasing a yaw angle speed as an output, or may be a yaw angle sensor that directly detects the yaw angle, or may be a direction sensor that detects the yaw angle by detecting the orientation of the vehicle body.

The invention is preferably provided with blade tilting means for tilting the blade in relation to the vehicle body by lifting or lowering the right or left end of the blade. Such blade tilting means preferably includes one hydraulic cylinder disposed between one end of the blade and the vehicle body and one brace disposed between the other end of the blade and the vehicle body.

Preferably, a traveling direction when the automatic blade control mode is set by the driving mode setting means is set as the target traveling direction for the vehicle body. When the traveling direction of the vehicle body is altered by manual operation with the automatic blade control mode being selected, the traveling direction after the alteration is preferably set as a new target traveling direction. In this case, the manual operation for altering the traveling direction of the vehicle body may be carried out by a steering lever or blade control lever.

There may be provided, as the automatic blade control mode, at least an automatic digging mode associated with digging in dozing operation and an automatic carrying mode associated with carrying in dozing operation.

The driving mode setting means may be a push button selector switch, a grip-type selector switch, a twisting-type selector switch or a rotary selector switch.

Other objects of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and accompanying drawings which are given by way of illustration only, and thus are not limitative of the present invention, and wherein:

FIG. 1 is a view of the external appearance of the bulldozer;

FIG. 2 is a schematic block diagram of the overall construction of the straight-ahead traveling control system;

FIG. 3 is a detail view of a blade lift cylinder stroke sensor;

FIG. 4 is a flowchart of a straight-ahead traveling program;

FIGS. 5(*a*) and 5(*b*) are characteristic maps representing right and left cylinder stroke angles respectively in relation to the output voltages of the blade lift cylinder stroke sensors;

FIG. 5(*c*) is a characteristic map representing the tilt angle of a blade in relation to the right and left cylinder stroke angles;

FIG. 6 is a characteristic map representing the inclination angle of a laterally inclined vehicle body in relation to the output voltage of a rolling angle sensor;

FIG. 7 is a characteristic map representing yaw rate gyro signals in relation to the output voltage of a yaw rate gyro;

FIG. 8 is a characteristic map representing the tilting amount of the blade in relation to yaw angles;

FIG. 9 is a characteristic map representing the tilting amount of the blade in relation to the tilt angle of the blade and the inclination angle of the laterally inclined vehicle body; and FIGS. 10(*a*) to 10(*d*) are diagrams each illustrating the blade during blade control operation.

PREFERRED EMBODIMENTS OF THE INVENTION

With reference to the drawings, a straight-ahead traveling control system for a bulldozer according to a preferred embodiment of the invention will be hereinafter described.

Figure 1:
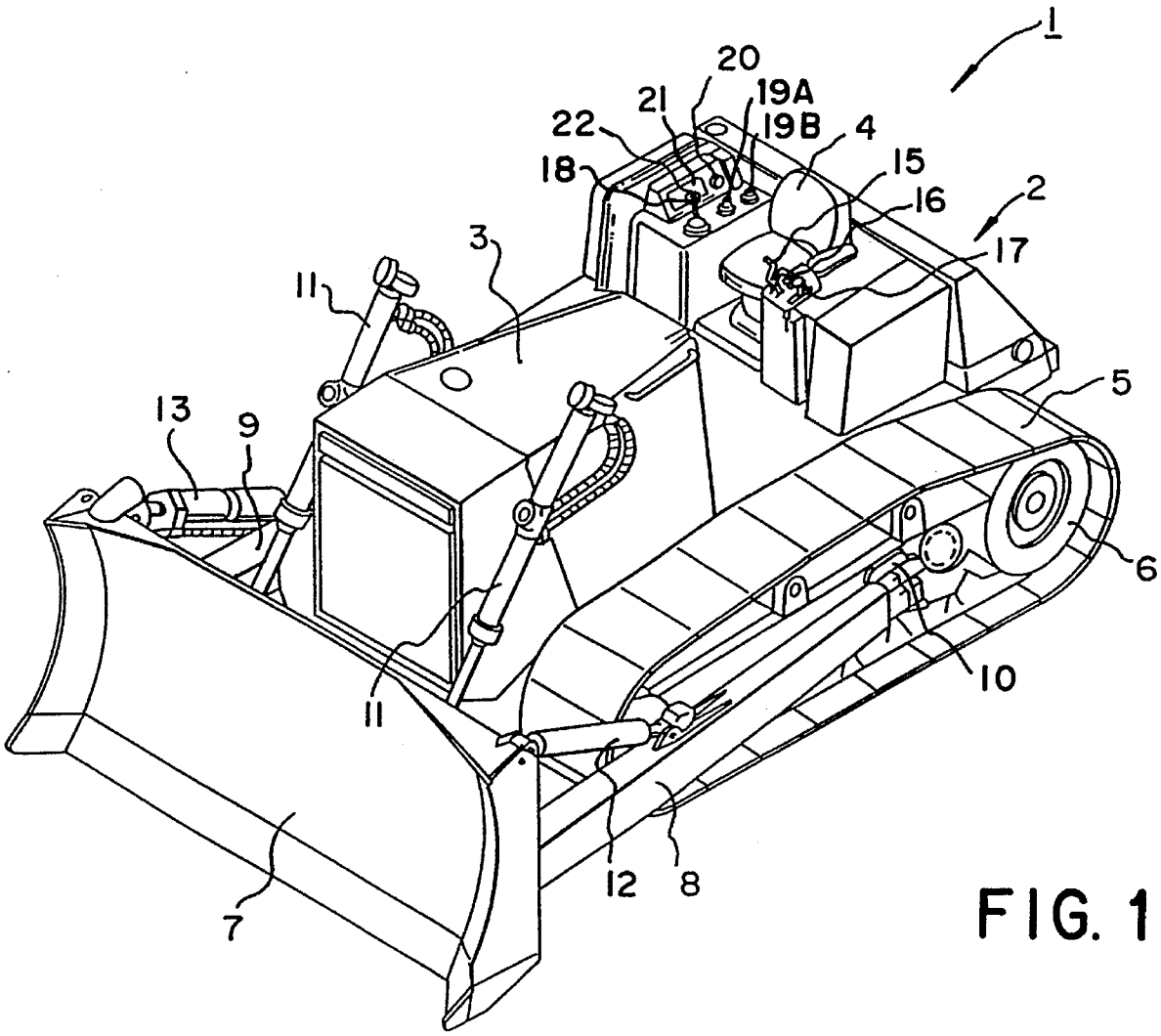
FIGS. 1 to 10 illustrate a preferred embodiment of a straight-ahead traveling control system for a bulldozer according to the invention.

Referring to FIG. 1, there is shown the external appearance of a bulldozer 1 which is provided with, on a vehicle body 2 thereof, a bonnet 3 for housing an engine (not shown) and an operator scat 4 for the operator who drives the bulldozer 1. Both sides (i.e., the right and left sides of the vehicle body 2 when viewed in its moving direction) of the vehicle body 2 are provided with crawler belts 5 (the crawler belt on the right side is not shown) for running the vehicle body 2 so as to turn or move back and forth. Each of these crawler belts 5 are independently driven by their respective sprockets 6 actuated by driving force transmitted from the engine.

There are provided straight frames 8, 9 for supporting a blade 7 at the forward ends thereof. The base ends of these right and left straight frames 8, 9 are pivotally supported at the right and left sides of the vehicle body 2 by means of trunnions 10 (the trunnion on the right side is not shown) in such a manner that the blade 7 can be lifted or lowered. Disposed between the blade 7 and the vehicle body 2 are right and left blade lift cylinders 11 forming a pair for lifting or lowering the blade 7. For functioning to incline the blade 7 to the right and left, a brace 12 is disposed between the blade 7 and the left straight frame 8 and a blade tilt cylinder 13 is disposed between the blade 7 and the right straight frame 9.

There are provided a steering lever 15, a transmission shift lever 16 and a fuel control lever 17 on the left of the operator seat 4 when the vehicle body 2 is viewed in its moving direction. On the right of the operator seat 4, there are provided a blade control lever 18 for lifting, lowering the blade 7 and inclining it to the right and left; a first dial switch 19A for setting a load to be applied to the blade 7 and a second dial switch 19B for correcting the set load by adding or subtracting a correction value; and a lock-up selector switch 20 for bringing a torque convertor into a locked-up state or releasing the torque convertor from the locked-up state; and a display unit 21. The top of the blade control lever 18 is provided with a driving mode selector button 22 for switching driving modes in dozing operation and so on. According to how many times the driving mode selector button 22 is pressed, the driving mode sequentially switches between a manual operation mode, an automatic digging mode and an automatic carrying mode in dozing operation. Although they are not shown in the drawing, a brake pedal and a decelerator pedal are disposed in front of the operator seat 4.

Figure 2:
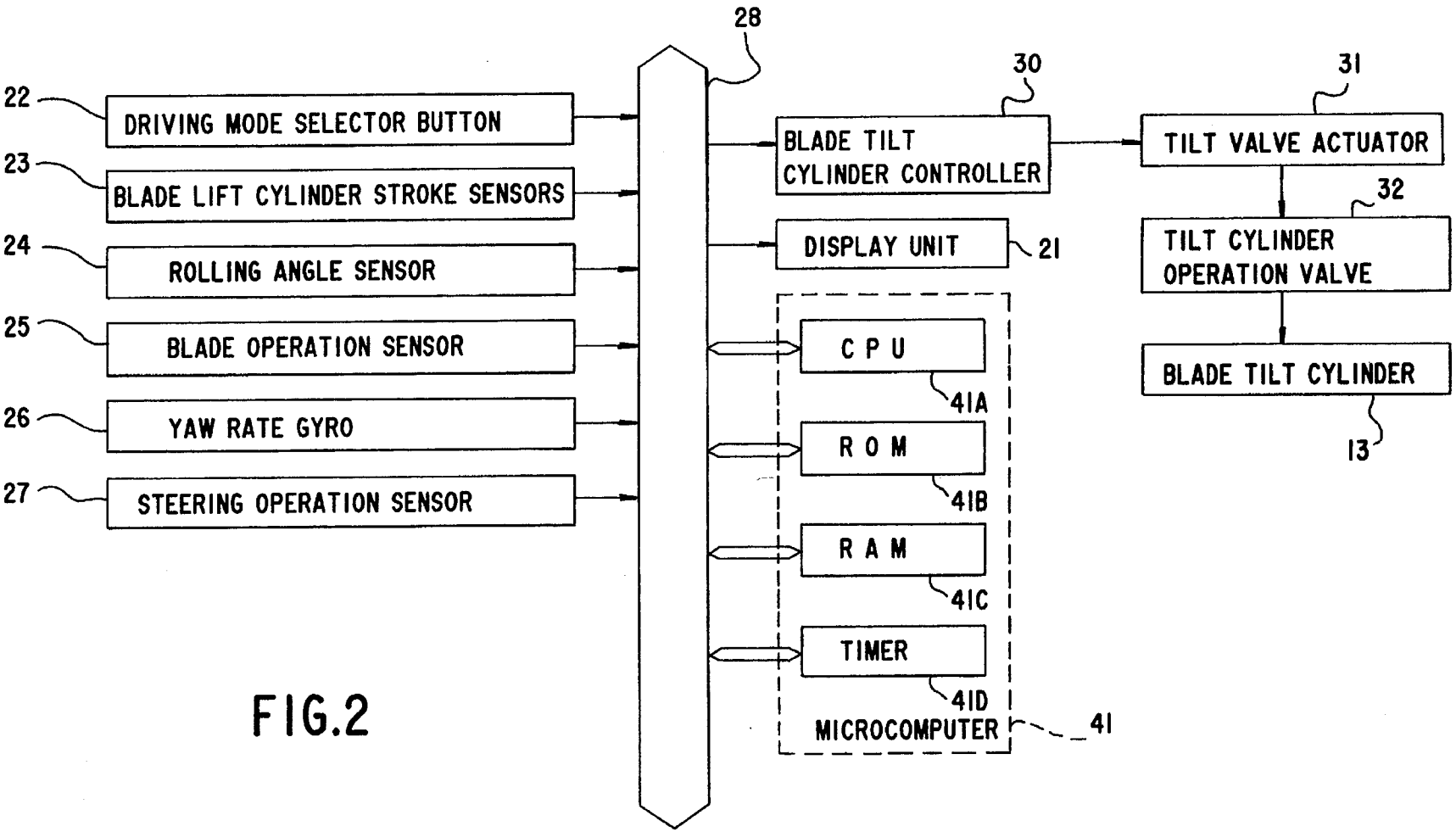

Referring to FIG. 2 which schematically shows the overall construction of the straight-ahead traveling control system for a bulldozer according to the invention, the following data items are supplied to a microcomputer 29 through a bus 28: (i) data on the pressing operation condition of the driving mode selector button 22 for switching between the manual operation mode, automatic digging mode and automatic carrying mode and so on in dozing operation; (ii) stroke positional data from blade lift cylinder stroke sensors 23 that detect the strokes of the right and left blade lift cylinders 11 for lifting or lowering the blade 7, respectively; (iii) rolling angle data from a rolling angle sensor 24 that detects the momentarily varying angle of the vehicle body 2 inclining in rolling directions (lateral rolling angle); (iv) data from a blade operation sensor 25 that detects whether or not the blade 7 is manually operated by the blade control lever 18; (v) yaw angle data from a yaw rate gyro 26 that detects the yaw angle of the vehicle body 2 in relation to a target traveling direction (the lateral yaw angle in relation to a target traveling direction); and (vi) data from a steering operation sensor 27 that detects whether a steering gear is manually operated by the steering lever 15.

The microcomputer 29 is composed of a central processing unit (CPU) 29A for executing a specified program; a read only memory (ROM) 29B for storing the above program and various characteristic maps; a random access memory (RAM) 29C serving as a working memory necessary for executing the program and as registers for various data; and a timer 29D for measuring elapsed time for an event in the program. The program is executed in accordance with (i) the data on the pressing operation condition of the driving mode selector button 22; (ii) the stroke positional data on the strokes of the right and left blade lift cylinders 11; (iii) the data on the rolling angle of the vehicle body 2; (iv) the data on whether or not the blade 7 is in manual operation; (v) the data on the yaw angle of the vehicle body 2 in relation to a target traveling direction; and (vi) the data on whether or not the steering gear is in manual operation. Then, data on a tilt operation amount used for tilting the blade 7 rightwards or leftwards is supplied to a blade tilt cylinder controller 30 which actuates the blade tilt cylinder 13 with the help of a tilt valve actuator 31 and a tilt cylinder operation valve 32, whereby the blade 7 is tilted. A display unit 21 displays information regarding whether the bulldozer 1 is presently in the manual operation mode, automatic digging mode, automatic carrying mode or other modes in dozing operation.

Figure 3:
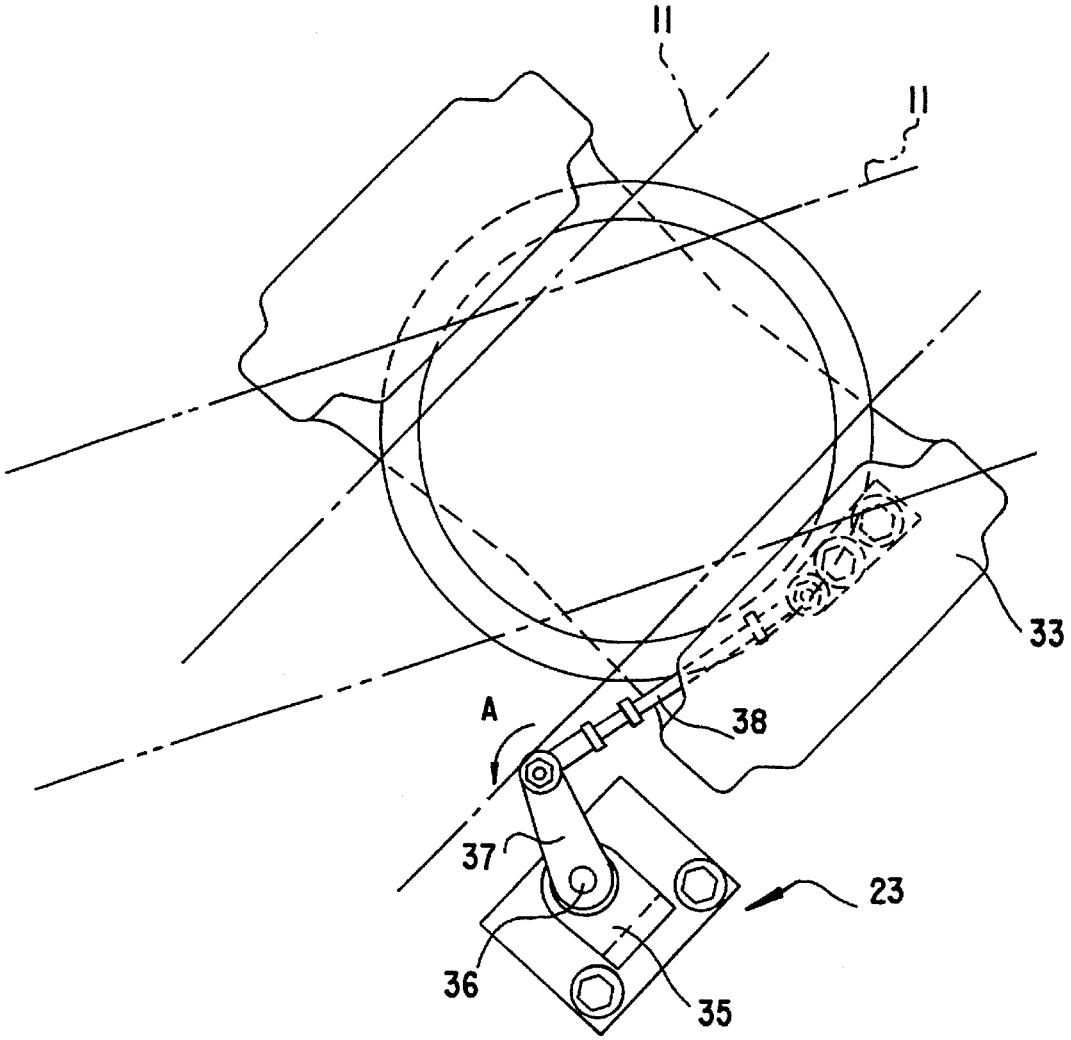

The blade lift cylinder stroke sensors 23 detect, as shown in FIG. 3, the strokes of the blade lift cylinders 11 respectively, by detecting the inclinations of the blade lift cylinders 11 (FIG. 3 shows, in an enlarged form, the left side of the bulldozer 1). The right and left blade lift cylinders 11 are supported on disk-like cylinder supports 34 respectively. The cylinder supports 34 are rotatably supported in a vertical plane in relation to brackets 33 secured to the vehicle body 2 of the bulldozer 1. Potentiometers 35 are attached to the vehicle body 2 at the positions where the cylinder supports 34 are adjacent to the vehicle body 2. The potentiometer 35 constitutes a part of the blade lift cylinder stroke sensor 23. The forward end of an arm 37 attached to a pivotal shaft 36 of the potentiometer 35 is coupled to a rotating part of the cylinder support 34 by means of a rod 38. When the blade lift cylinder 11 is actuated to pivot from the position indicated by a chain line to the position indicated by a two-dot chain line in FIG. 4, the arm 37 pivots in the direction of arrow A, being pushed by the rod 38 and the pivotal angle of the arm 37 is detected by the potentiometer 35. Since the blade lift cylinder stroke sensor 23 is provided for each of the right and left blade lift cylinders 11, the tilting amount of the blade 7 tilted by the blade tilt cylinder 13 can be detected by obtaining the difference between the pivotal angles of the blade lift cylinders 11, the pivotal angles being detected by the right and left blade lift cylinder stroke sensors 23.

Figure 4:
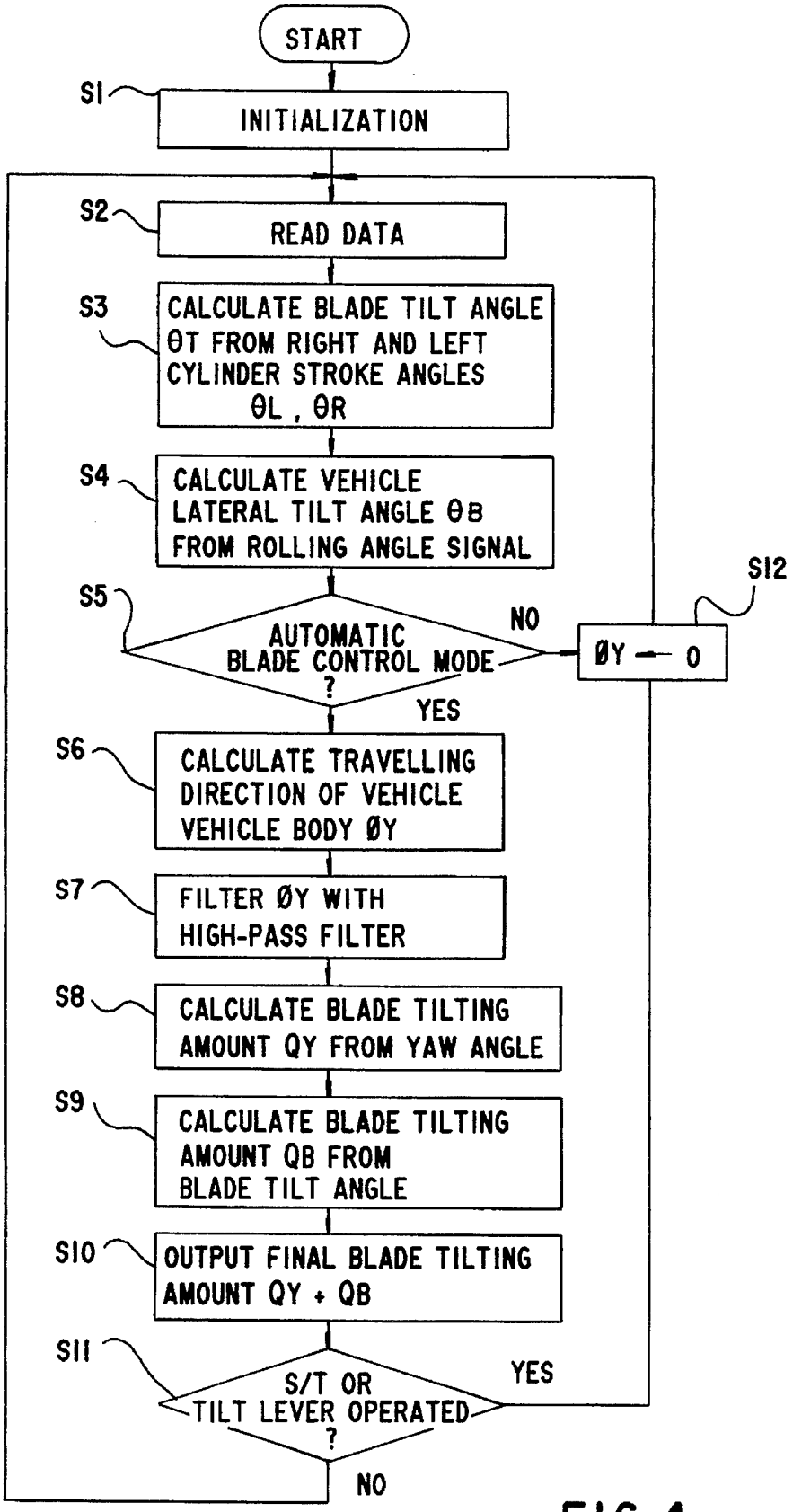

Now reference is made to the flowchart of FIG. 4 for describing, in detail, the performance of the above-described straight-ahead traveling control unit for a bulldozer.

Step 1: Power is loaded to start execution of the specified program and to execute initialization such as clearing of all the data of the registers in the RAM 29C of the microcomputer 29 and resetting of various timers in the timer 29D.

Step 2 to Step 4: The following data are firstly read: (i) the data from the driving mode selector button 22, regarding the pressing operation condition; (ii) the stroke positional data from the blade lift cylinder stroke sensors 23, regarding the strokes of the right and left blade lift cylinders 11; (iii) the rolling angle data from the rolling angle sensor 24, regarding the rolling angle of the vehicle body 2; (iv) the data from the blade operation sensor 25, regarding whether or not the blade 7 is in manual operation; (v) the yaw angle data from the yaw rate gyro 26, regarding the yaw angle of the vehicle body 2 in relation to a target traveling direction; and (vi) the data from the steering operation sensor 27, regarding whether or not the steering gear is in manual operation.

Figure 5A:
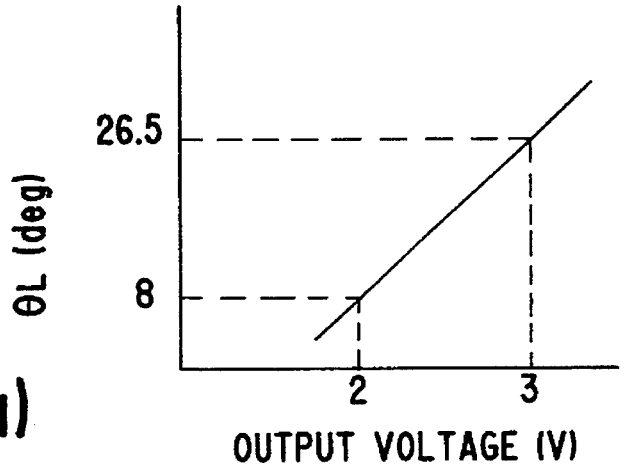
Figure 5B:
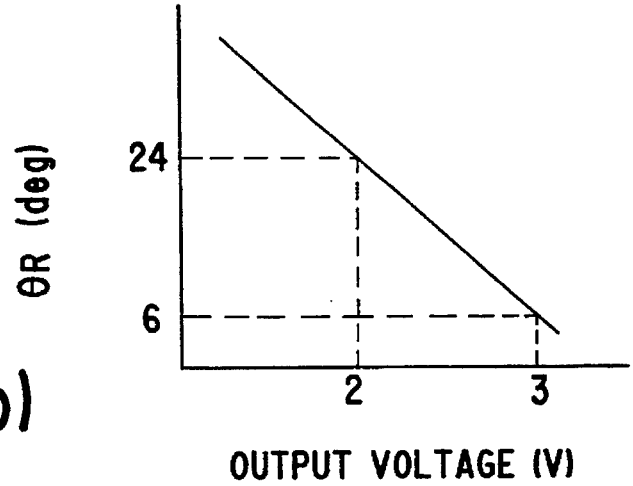
Figure 5C:
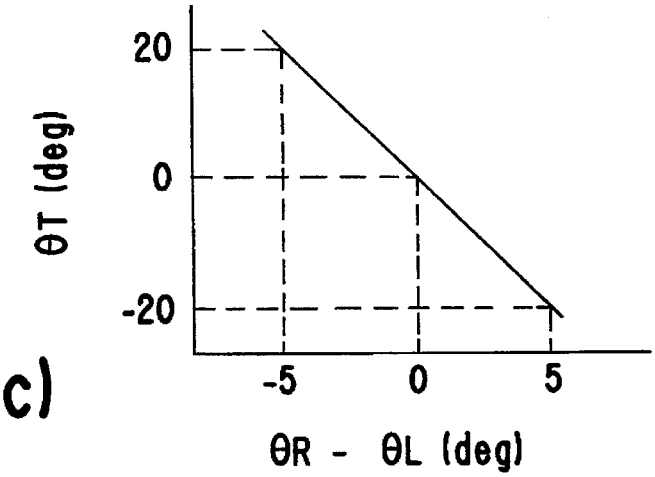

Then, the tilt angle $\theta_T$ (in a lateral direction) of the blade 7 in relation to the vehicle body 2 is calculated from the stroke positional data of the right and left blade lift cylinders 11 sent from the blade lift cylinder stroke sensors 23, i.e., the data on cylinder stroke angles $\theta_L$, $\theta_R$. In FIGS. 5(*a*) and 5(*b*), the left cylinder stroke angle $\theta_L$ is represented by a characteristic line rising diagonally to the right in relation to the output voltage (V) of the left blade lift cylinder stroke sensor 27, while the right cylinder stroke angle $\theta_R$ is represented by a characteristic line declining diagonally to the right in relation to the output voltage (V) of the right blade lift cylinder stroke sensor 27. As shown In FIG. 5(*c*), the tilt angle $\theta_T$ is represented by a characteristic line that declines diagonally to the right in relation to the difference $(\theta_R-\theta_L)$ between the cylinder stroke angles $\theta_L$, $\theta_R$.

Figure 6:
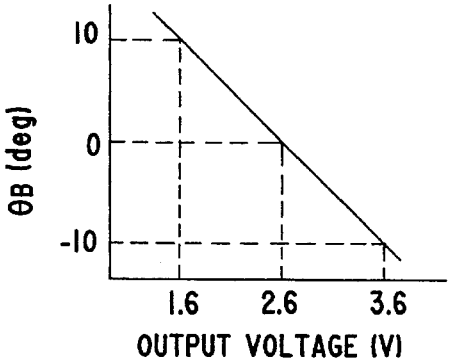

Then, the angle $\theta_B$ of the vehicle body 2 inclined in a rolling direction in relation to the ground is calculated from a signal sent from the rolling angle sensor (clinometer) 24. In FIG. 6, the rolling angle $\theta_B$ is represented by a characteristic line which declines diagonally to the right in relation to the output voltage (V) of the rolling angle sensor 24.

Figure 7:
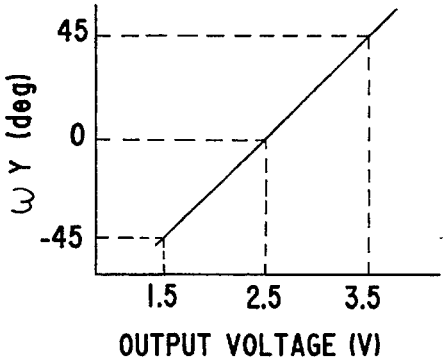

Step 5 to Step 10: When the driving mode selector button 22 has been pressed to select an automatic blade control mode, the yaw angle $\omega_Y$ of the vehicle body 2 relative to a target traveling direction is calculated by integrating a yaw rate gyro signal $\phi_Y$ from the yaw rate gyro 26. In FIG. 7, the yaw rate gyro signal $\omega_Y$ is represented by a characteristic line that rises diagonally to the right in relation to the output voltage (V) of the yaw rate gyro 26. The automatic blade control mode mentioned above is either the automatic digging mode that is selected when the driving mode selector button 22 is pressed once or the automatic carrying mode that is selected when the driving mode selector button 22 is pressed twice. It is noted that when the driving mode selector button 22 is not pressed or pressed three times, the manual operation mode is selected.

Figure 8:
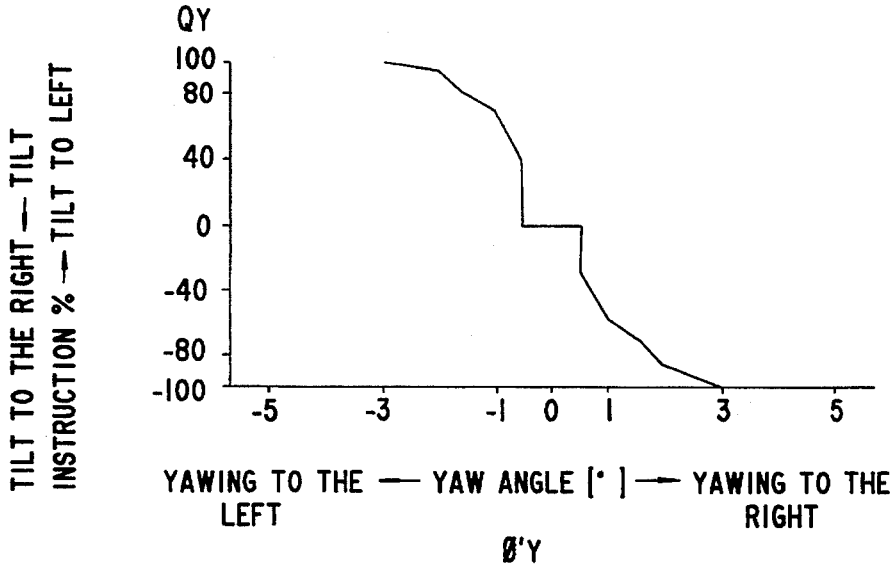
Figure 9:
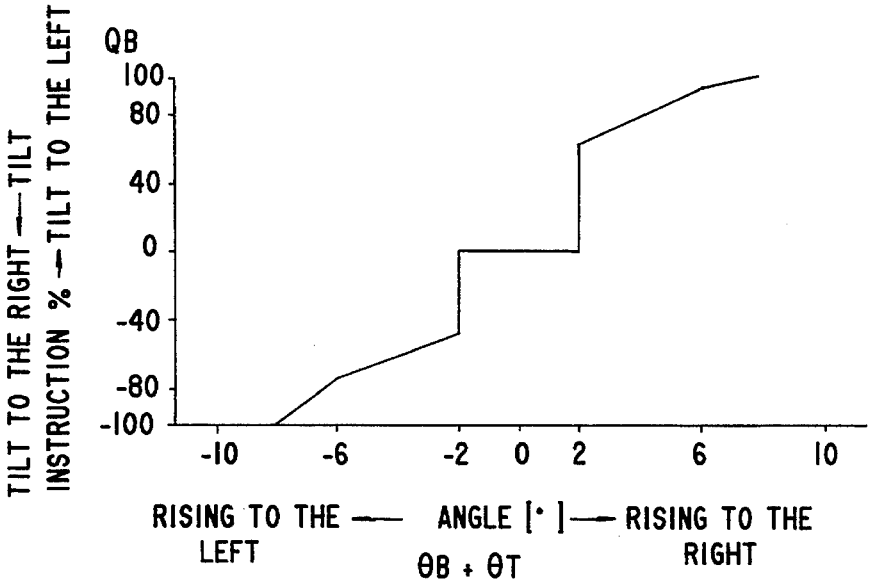
Figure 10A:
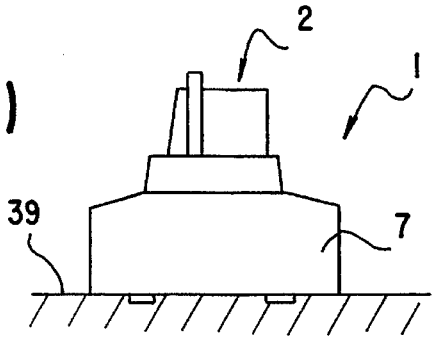
Figure 10B:
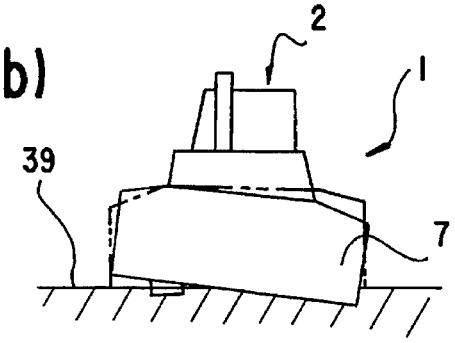
Figure 10C:
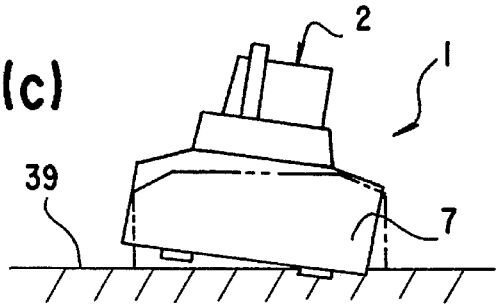
Figure 10D:
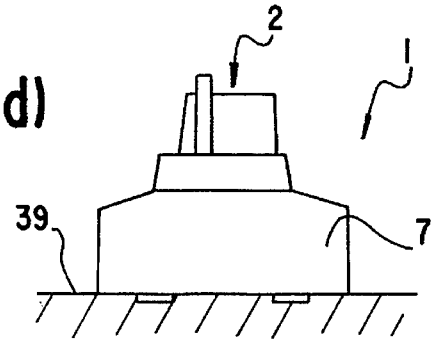

Then, in order to eliminate the drift of the output value of the yaw angle $\phi_Y$ thus calculated, a high-pass filtered yaw angle $\phi'_Y$ is obtained by filtering the yaw angle $\phi_Y$ with a high-pass filter. Based on the high-pass filtered yaw angle $\phi'_Y$, a blade tilt amount $Q_Y$ used for driving the vehicle body straight ahead (straight-ahead traveling control) is calculated from a control characteristic map shown in FIG. 8. Thereafter, based on the angle of the blade 7 laterally tilted in relation to the ground that is given by the sum of the tilt angle $\theta_T$ of the blade 7 relative to the vehicle body 2 and the rolling angle $\theta_B$ of the vehicle body 2 relative to the ground $(\theta_T+\theta_B)$, a blade tilt amount $Q_B$ used for forming a laterally horizontal earth surface after digging by the blade is calculated from a control characteristic map shown in FIG. 9. Then, a final blade tilt amount $Q_Y+Q_B$ is obtained by adding the blade tilt amount $Q_Y$ to the blade tilt amount $Q_B$, and this final blade tilt amount $Q_Y+Q_B$ is released as the final instruction to the blade tilt cylinder controller 30. The blade tilt cylinder controller 30 actuates the blade tilt cylinder 13 through the tilt valve actuator 31 and the tilt cylinder operation valve 32.

Step 11 to Step 12: When the steering lever 15 or blade control lever (tilt lever) 18 has been operated by manual intervention by the operator to alter the traveling direction of the vehicle body 2, the yaw angle $\phi_Y$ that has been already obtained is set to 0 and the traveling direction after the alteration is set as a new target traveling direction. Similarly, the yaw direction $\phi_Y$ is set to 0 when the manual operation mode is selected.

Reference is made to FIG. 10 for describing examples of actions which the blade 7 takes when the above-described control is performed. At the start of digging, the blade 7 is so positioned, as shown in FIG. 10(*a*), that its tilt angle is horizontal in relation to the vehicle body 2. In this condition, if a partial load is applied to the blade 7, thereby changing the traveling direction of the bulldozer 1, the tilt angle of the blade 7 is changed as indicated by a two-dot chain line so that the bulldozer 1 restores the previous traveling direction. If the vehicle body 2 is inclined laterally as shown in FIG. 10(*c*), thereby tilting the blade 7 relative to the ground 39, the tilt angle of the blade 7 is also changed as indicated by a two-dot chain line so that the blade 7 becomes horizontal relative to the ground 39. When the vehicle body 2 has become horizontal again relative to the ground 39 as shown in FIG. 10(*d*), the blade 7 becomes also horizontal relative to the ground 39.

Although the invention has been particularly described with the rolling angle sensor for detecting the angle of the vehicle body 2 in a rolling direction in the above embodiment, this rolling angle sensor may be replaced by a detector that detects a rolling angle by integrating data sent from a rolling rate gyro which releases a rolling angle speed as an output. Also, instead of the detector which detects a yaw angle by integrating a yaw rate gyro signal from the yaw rate gyro 26, a yaw angle sensor for directly detecting a yaw angle or a direction sensor for detecting a yaw angle through sensing the orientation of the vehicle body may be used in order to obtain the yaw angle of the vehicle body 2.

While a tilt amount for the blade 7 is detected by calculating the difference between the pivotal angles of the right and left-blade lift cylinders 11 which are detected by their respective blade lift cylinder stroke sensors 23 in the foregoing embodiment, it is apparent that a tilt amount may be detected by measuring the length of each blade lift cylinder and obtaining the difference between the lengths of the blade lift cylinders.

For switching between the manual operation mode, the automatic digging mode and the automatic carrying mode in dozing operation, the foregoing embodiment employs the driving mode selector button 22 operated by depressing. This selector button 22 could be replaced by a grip-type selector switch, a twisting-type selector switch or a rotary selector switch.

The invention being thus described, it will be obvious that the same may be varied in many ways. Such variations are not to be regarded as a departure from time spirit and scope of the invention, and all such modifications as would be obvious to one skilled in the art are intended to be included within the scope of the following claims.

What is claimed is:

1. A straight-ahead traveling control system for a bulldozer comprising:

(a) driving mode setting means which can set an automatic blade control mode for dozing operation;

(b) yaw angle detector means for detecting a yaw angle of a vehicle body in relation to a target traveling direction for the vehicle body;

(c) blade tilt angle detector means for detecting a tilt angle of a blade tilting laterally in relation to the ground; and (d) blade controller means for controlling tilting of the blade based on a final tilting amount obtained by adding a first blade tilting amount used for driving the vehicle body straight ahead to a second blade tilting amount used for forming a laterally horizontal earth surface after digging by the blade, the first blade tilting amount being obtained from the yaw angle of the vehicle body detected by the yaw angle detector means and the second blade tilting amount being obtained from the tilt angle of the blade detected by the blade tilt angle detector means, when the driving mode setting means has set the automatic blade control mode.

2. The straight-ahead traveling control system for a bulldozer as set forth in claim 1, wherein the blade tilt angle detector means includes rolling angle detector means for detecting the rolling angle of the vehicle body in relation to the ground and blade angle detector means for detecting the tilt angle of the blade tilting laterally in relation to the vehicle body.

3. The straight-ahead traveling control system for a bulldozer as set forth in claim 2, wherein the rolling angle detector means is a detector that detects the rolling angle by integrating data sent from a rolling rate gyro for releasing a rolling angle speed as an output; or a rolling angle sensor that directly detects the rolling angle.

4. The straight-ahead traveling control system for a bulldozer as set forth in claim 2, wherein the blade angle detector means is a detector that detects the tilt angle of the laterally tilting blade by detecting the difference between respective pivotal angles of right and left blade lift cylinders for lifting or lowering the blade.

5. The straight-ahead traveling control system for a bulldozer as set forth in claim 2, wherein the blade angle detector means is a detector that detects the tilt angle of the laterally tilting blade, by detecting the difference between the respective cylinder lengths of the right and left blade lift cylinders for lifting or lowering the blade.

6. The straight-ahead traveling control system for a bulldozer as set forth in claim 1, wherein the yaw angle detector means is a detector that detects the yaw angle by integrating data sent from a yaw rate gyro for releasing a yaw angle speed as an output; or a yaw angle sensor that directly detects the yaw angle; or a direction sensor that detects the yaw angle by detecting the orientation of the vehicle body.

7. The straight-ahead traveling control system for a bulldozer as set forth in claim 1, further comprising blade tilting means for tilting the blade in relation to the vehicle body by lifting or lowering the right or left end of the blade.

8. The straight-ahead traveling control system for a bulldozer as set forth in claim 7, wherein the blade tilting means includes one hydraulic cylinder disposed between one end of the blade and the vehicle body and one brace disposed between the other end of the blade and the vehicle body.

9. The straight-ahead traveling control system for a bulldozer as set forth in claim 1, wherein a traveling direction when the automatic blade control mode is set by the driving mode setting means is set as the target traveling direction for the vehicle body.

10. The straight-ahead traveling control system for a bulldozer as set forth in claim 9, wherein when the traveling direction of the vehicle body has been altered by manual operation with the automatic blade control mode being selected, the traveling direction after the alteration is set as a new target traveling direction.

11. The straight-ahead traveling control system for a bulldozer as set forth in claim 10, wherein the manual operation for altering the traveling direction of the vehicle body is carried out by a steering lever or blade control lever.

12. The straight-ahead traveling control system for a bulldozer as set forth in claim 1, 9 or 10, wherein there are provided, as the automatic blade control mode, at least an automatic digging mode associated with digging in dozing operation and all automatic carrying mode associated with carrying in dozing operation.

13. The straight-ahead traveling control system for a bulldozer as set forth in claim 1 or 9, wherein the driving mode setting means is a push button selector switch, a grip-type selector switch, a twisting-type selector switch or a rotary selector switch.

* * * * *